US012624426B2

(12) United States Patent
Smith et al.

(10) Patent No.: US 12,624,426 B2
(45) Date of Patent: May 12, 2026

(54) HIGH ENTROPY ALLOY

(71) Applicant: Raytheon Technologies Corporation, Farmington, CT (US)

(72) Inventors: Kenneth D. Smith, East Longmeadow, MA (US); John A. Sharon, West Hartford, CT (US); Ryan M. Deacon, Colchester, CT (US); Soumalya Sarkar, Manchester, CT (US)

(73) Assignee: RTX Corporation, Farmington, CT (US)

( * ) Notice: Subject to any disclaimer, the term of this patent is extended or adjusted under 35 U.S.C. 154(b) by 373 days.

(21) Appl. No.: 18/205,757

(22) Filed: Jun. 5, 2023

(65) Prior Publication Data

US 2023/0392236 A1 Dec. 7, 2023

Related U.S. Application Data

(60) Provisional application No. 63/348,976, filed on Jun. 3, 2022, provisional application No. 63/348,981, filed on Jun. 3, 2022.

(51) Int. Cl.
*C22C 30/00* (2006.01)

(52) U.S. Cl.
CPC ..... *C22C 30/00* (2013.01)

(58) Field of Classification Search
CPC ..... C22C 30/00
See application file for complete search history.

(56) References Cited

U.S. PATENT DOCUMENTS

| | | | | |
|---|---|---|---|---|
| 10,668,566 | B2 | 6/2020 | Smathers et al. | |
| 11,725,889 | B1 * | 8/2023 | Kustas | B33Y 80/00 165/138 |
| 2017/0314097 | A1 | 11/2017 | Hong et al. | |
| 2020/0261980 | A1 | 8/2020 | Mironets et al. | |
| 2021/0146602 | A1 | 5/2021 | Shuck et al. | |
| 2022/0112608 | A1 | 4/2022 | Tang et al. | |
| 2022/0115660 | A1 | 4/2022 | Anasori et al. | |

FOREIGN PATENT DOCUMENTS

| | | | |
|---|---|---|---|
| CN | 107267841 | B | 8/2018 |
| CN | 113549780 | A | 10/2021 |
| KR | 10-2017-0027520 | A | 3/2017 |
| KR | 10-2096311 | B1 | 4/2020 |
| KR | 102096297 | B1 | 4/2020 |

OTHER PUBLICATIONS

V.F. Gorban et al., "Strength and Plasticity of Cast Solid-Soluble High-Entropy Alloys", Strength of Materials, Sep. 5, 2020, pp. 700-706, vol. 52, No. 5, Springer Science + Business Media, LLC, New York, NY.

Yong Zhang et al., "Microstructures and Properties of High-Entropy Alloys", Progress in Materials Science, Apr. 2014, pp. 1-93, vol. 61, Elsevier, Amsterdam, Netherlands.

(Continued)

*Primary Examiner* — Ricardo D Morales
(74) *Attorney, Agent, or Firm* — Bachman & LaPointe, P.C.

(57) ABSTRACT

An alloy comprising by weight percent: 16.0-26.0 Cr; 23.0-34.0 Mo; 21.0-31.0 Ta; 0.50-3.5 Ti; and 17.0-27.0 V.

20 Claims, 2 Drawing Sheets

(56) References Cited

OTHER PUBLICATIONS

Ivan A. Ditenberg et al., "Structure and Phase Composition of a W—Ta—Mo—Nb—V—Cr—Zr—Ti Alloy Obtained by Ball Milling and Spark Plasma Sintering", Entropy, Jan. 2020, vol. 22, No. 2, MDPI, Basel, Switzerland.
Extended European Search Report dated Aug. 24, 2023 for European Patent Application No. 23177335.9.
Bronislava Gorr et al., "A new strategy to intrinsically protect refractory metal based alloys at ultra high temperatures", Corrosion Science, Jan. 2020, Elsevier Ltd., Amsterdam, the Netherlands.
Bronislava Gorr et al., "High-Temperature Oxidation Behavior of Refractory High-Entropy Alloys: Effect of Alloy Composition", Oxid Met, Jan. 5, 2017, pp. 339-349, Springer, Berlin, Germany.
S. Gorsse et al., "Database on the mechanical properties of high entropy alloys and complex concentrated alloys", Data in Brief, Nov. 2018, pp. 2664-2678, Elsevier Ltd., Amsterdam, the Netherlands.
O.N. Senkov et al., "Accelerated exploration of multi-principal element alloys with solid solution phases", Nature Communications, Mar. 5, 2015, Macmillan Publishers Limited, London, United Kingdom.
Kevin Kaufmann et al., "Searching for High Entropy Alloys: A Machine Learning Approach", Acta Materialia Inc., Oct. 1, 2020, pp. 178-222, vol. 198, Elsevier Ltd., Amsterdam, Netherlands.
Syed I.A. Jalali et al., "Capturing the Ultrahigh Temperature Response of Materials with Sub-Scale Tensile Testing", Materials Today, Nov. 2024 (online Sep. 13, 2024), pp. 87-100, vol. 80, Elsevier Ltd., Amsterdam, Netherlands.
European Office Action dated Nov. 29, 2024 for European Patent Application No. 23177335.9.

* cited by examiner

HIGH ENTROPY ALLOY

CROSS-REFERENCE TO RELATED APPLICATIONS

Benefit is claimed of U.S. Patent Application No. 63/348,976, filed Jun. 3, 2022, and entitled "High Entropy Alloy" and U.S. Patent Application No. 63/348,981, filed Jun. 3, 2022, and entitled "High Entropy Alloy", the disclosures of which are incorporated by reference herein in their entireties as if set forth at length.

BACKGROUND

The disclosure relates to gas turbine engines. More particularly, the disclosure relates to high entropy alloys.

Gas turbine engines (used in propulsion and power applications and broadly inclusive of turbojets, turboprops, turbofans, turbo shafts, industrial gas turbines, and the like) are subject to ever increasing thermal requirements in their hot sections (combustors, turbine sections, exhaust nozzles, and the like). Sequential generations of typically nickel-based superalloys have been developed in various compositions for rotating components (e.g., blades and disks either separate or integral) and static components (e.g., combustor panels, blade outer air seals, vanes, and the like). Additionally, to address the increasing thermal demands, various ceramics and ceramic matrix composite compositions have been proposed.

United States Patent Application Publication 20200261980 A1, Mironet, et al., published Aug. 20, 2020, and entitled "METHOD FOR IDENTIFYING AND FORMING VIABLE HIGH ENTROPY ALLOYS VIA ADDITIVE MANUFACTURING", discloses HEA processing methods.

United States Patent Application Publication 20220112608 A1, Tang, et al., published Apr. 14, 2022, and entitled "ENVIRONMENTAL BARRIER COATING", (the '608 publication), the disclosure of which is incorporated by reference herein in its entirety as if set forth at length, discloses a coating system for HEA. The example coating system has an underlying diffusion barrier atop the substrate, a bondcoat atop the diffusion barrier, and a ceramic top coat.

SUMMARY

One aspect of the disclosure involves an alloy comprising by weight percent: 16.0-26.0 Cr; 23.0-34.0 Mo; 21.0-31.0 Ta; 0.50-3.5 Ti; and 17.0-27.0 V.

In a further embodiment of any of the foregoing embodiments, additionally and/or alternatively, the alloy comprises in weight percent: 19.25-23.25 Cr; 27.10-31.10 Mo; 24.25-28.25 Ta; 0.5-2.25 Ti; and 20.15-24.15 V.

In a further embodiment of any of the foregoing embodiments, additionally and/or alternatively, the alloy comprises in weight percent: 20.25-22.25 Cr; 28.10-30.10 Mo; 25.25-27.25 Ta; 0.75-1.75 Ti; and 21.15-23.15 V.

In a further embodiment of any of the foregoing embodiments, additionally and/or alternatively, the alloy comprises in weight percent: no more than 4.0 Nb, if any; no more than 4.0 Zr, if any; no more than 4.0 W, if any; no more than 4.0 Al, if any; and no more than 6.0 all other elements, if any, combined.

In a further embodiment of any of the foregoing embodiments, additionally and/or alternatively, the alloy comprises in weight percent: no more than 3.0 all other elements individually, if any; and no more than 6.0 all other elements, if any, combined.

In a further embodiment of any of the foregoing embodiments, additionally and/or alternatively, the alloy comprises in weight percent: no more than 1.0 all other elements individually, if any; and no more than 3.0 all other elements, if any, combined.

In a further embodiment of any of the foregoing embodiments, additionally and/or alternatively, the alloy consists essentially of: said Cr; said Mo; said Ta; said V; said Ti; up to 2.0 weight percent each Y and Si, if any; and up to 0.50 weight percent each B, C, O, and N, if any.

In a further embodiment of any of the foregoing embodiments, additionally and/or alternatively, the alloy comprises in atomic percent: 31 Cr; 23 Mo; 11 Ta; 2 Ti; and 33 V.

In a further embodiment of any of the foregoing embodiments, additionally and/or alternatively, the alloy has at least one of: a density of 8.80 to 9.10 grams per cubic centimeter; a 1300° C. yield point of at least 500 MPa; and a melting point of at least 1600° C.

In a further embodiment of any of the foregoing embodiments, additionally and/or alternatively, the alloy has a BCC structure.

In a further embodiment of any of the foregoing embodiments, additionally and/or alternatively, the alloy is a coated substrate having a coating comprising one or more: silicide-based coatings; zirconia-yttria based coatings; rare-earth oxide coatings; and mixtures thereof.

In a further embodiment of any of the foregoing embodiments, additionally and/or alternatively, a gas turbine engine component includes the alloy and further comprising: a coating.

In a further embodiment of any of the foregoing embodiments, additionally and/or alternatively, the gas turbine engine component is a hot section component.

In a further embodiment of any of the foregoing embodiments, additionally and/or alternatively, the gas turbine engine component is selected from the group consisting of: blades, vanes, blade outer air seals; combustor shell pieces, combustor heat shield pieces, combustor fuel nozzles, and combustor fuel nozzle guides.

A further second aspect of the disclosure involves, an alloy comprising by weight percent: 9.0-15.0 Cr; 21.75-31.75 Mo; 40.0-50.0 Ta; 9.5-15.5 V; and 1.5-4.5 Zr.

In a further embodiment of any of the foregoing embodiments, additionally and/or alternatively, the alloy comprises in weight percent: no more than 4.0 Nb, if any; no more than 4.0 Ti, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy comprises in weight percent: 11.0-13.0 Cr; 24.75-28.75 Mo; 41.3-49.3 Ta; 11.6-13.6 V; 2.3-4.3 Zr; no more than 2.0 Nb, if any; no more than 2.0 Ti, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy comprises in weight percent: 11.5-12.5 Cr; 25.75-27.75 Mo; 43.3-47.3 Ta; 12.1-13.1 V; 2.7-3.7 Zr; no more than 2.0 Nb, if any; no more than 2.0 Ti, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy has at least one of: a BCC structure; a density of 10.0 to 10.9 grams per cubic centimeter; a 1300° C. yield point of at least 800 MPa; and a melting point of at least 1500° C.

A further third aspect of the disclosure involves, an alloy comprising by weight percent: 10.0-16.0 Cr; 26.0-36.0 Mo; 37.5-47.5 Ta; 2.0-5.0 Ti; and 6.0-12.0 V.

In a further embodiment of any of the foregoing embodiments, additionally and/or alternatively, the alloy comprises in weight percent: no more than 4.0 Nb, if any; no more than 4.0 Zr, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy comprises in weight percent: 12.1-14.1 Cr; 28.0-34.0 Mo; 39.4-47.4 Ta; 2.4-4.4 Ti; 8.1-10.1 V; no more than 2.0 Nb, if any; no more than 2.0 Zr, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy comprises in weight percent: 12.6-13.6 Cr; 28.0-34.0 Mo; 41.4-45.4 Ta; 2.9-3.9 Ti; 8.6-9.6 V; no more than 2.0 Nb, if any; no more than 2.0 Zr, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy has at least one of: a BCC structure; a density of 9.9 to 10.7 grams per cubic centimeter; a 1300° C. yield point of at least 500 MPa; and a melting point of at least 1600° C.

A further fourth aspect of the disclosure involves an alloy comprising by weight percent: 4.8-7.8 Cr; 31.0-41.0 Mo; 21.0-31.0 Ta; 12.0-18.0 Ti; and 13.0-19.0 V.

In a further embodiment of any of the foregoing embodiments, additionally and/or alternatively, the alloy comprises in weight percent: no more than 4.0 Nb, if any; no more than 4.0 Zr, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy comprises in weight percent: 5.3-7.3 Cr; 33.0-39.0 Mo; 24.2-28.2 Ta; 14.1-16.1 Ti; 15.3-17.3 V; no more than 2.0 Nb, if any; no more than 2.0 Zr, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy comprises in weight percent: 5.8-6.8 Cr; 34.5-37.5 Mo; 25.2-27.2 Ta; 14.6-15.6 Ti; 15.8-16.8 V; no more than 2.0 Nb, if any; no more than 2.0 Zr, if any; no more than 2.0 W, if any; no more than 2.0 Al, if any; no more than 2.0 all other elements individually, if any; and no more than 4.0 all other elements, if any, combined.

In a further embodiment of any of the foregoing embodiments, additionally and/or alternatively, the alloy has at least one of: a BCC structure; a density of 8.1 to 8.7 grams per cubic centimeter; a 1300° C. yield point of at least 190 MPa; and a melting point of at least 1500° C.

A further fifth aspect of the disclosure involves an alloy comprising by weight percent: 4.8-26.0 Cr; 24.0-41.0 Mo; 21.0-31.0 Ta; 0.50-18.0 Ti; and 13.0-27.0 V, wherein: combined Cr and Ti content is 16.5-29.5 weight percent.

In a further embodiment of any of the foregoing embodiments, additionally and/or alternatively, the alloy further comprises in weight percent: no more than 4.0 Nb, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy consists essentially of: said Cr; said Mo; said Ta; said V; said Ti; up to 2.0 weight percent each Y and Si, if any; and up to 0.50 weight percent each B, C, O, and N, if any.

A further sixth aspect of the disclosure involves an alloy comprising by weight percent: 9.0-16.0 Cr; 21.75-36.0 Mo; 37.5-50.0 Ta; 6.0-15.5 V; and 1.5-5.0 Ti and Zr combined.

In a further embodiment of any of the foregoing embodiments, additionally and/or alternatively, the alloy further comprises in weight percent: no more than 4.0 Nb, if any; no more than 4.0 Zr, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy consists essentially of: said Cr; said Mo; said Ta; said V; said Ti, if any; said Zr, if any; up to 2.0 weight percent each Y and Si, if any; and up to 0.50 weight percent each B, C, O, and N, if any.

A further seventh aspect of the disclosure involves an alloy comprising by weight percent: 9.0-26.0 Cr; 21.75-34.0 Mo; 21.0-50.0 Ta; 9.5-27.0 V; 0.5-3.5 Ti; no more than 4.5 Zr, if any; and 0.5-5.0 said Ti and Zr combined.

In a further embodiment of any of the foregoing embodiments, additionally and/or alternatively, the alloy further comprises in weight percent: no more than 4.0 Nb, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy consists essentially of: said Cr; said Mo; said Ta; said V; said Ti; said Zr, if any; up to 2.0 weight percent each Y and Si, if any; and up to 0.50 weight percent each B, C, O, and N, if any.

A further eighth aspect of the disclosure involves an alloy comprising by weight percent: 4.8-26.0 Cr; 21.75-41.0 Mo; 21.0-50.0 Ta; 6.0-27.0 V; no more than 18.0 Ti, if any; and no more than 5.0 Zr, if any.

In a further embodiment of any of the foregoing embodiments, additionally and/or alternatively, wherein in weight percent: (Mo+Ta) is 45.0-80.0; and (Cr/V) is 0.25-1.6.

In a further embodiment of any of the foregoing embodiments, additionally and/or alternatively, the alloy further comprises in weight percent: no more than 4.0 Nb, if any; no more than 4.0 W, if any; no more than 4.0 Al, if any; no more than 3.0 all other elements individually, if any; and no more than 6.0 all other elements, if any, combined.

In a further embodiment of any of the foregoing embodiments, additionally and/or alternatively, the alloy consists essentially of: said Cr; said Mo; said Ta; said V; said Ti, if any; said Zr, if any; up to 2.0 weight percent each Y and Si, if any; and up to 0.50 weight percent each B, C, O, and N, if any.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Typical superalloys thermal capabilities up to about 1150° C. (limit of the alloy, e.g., at the substrate of a coated part where the outer surface of the coating may be at a higher temperature) which is the generally cited temperature for the sixth-generation superalloy, TMS-238. Earlier generations of nickel-based superalloys have cited temperature capabilities of 1100° C. or less. Ceramic matrix composites (CMC) are often cited for higher potential service temperatures. But not all components can be made of CMC and thus there is a need for higher performance alloy components. Accordingly, a novel high entropy alloy (HEA) is proposed.

Figure 1:
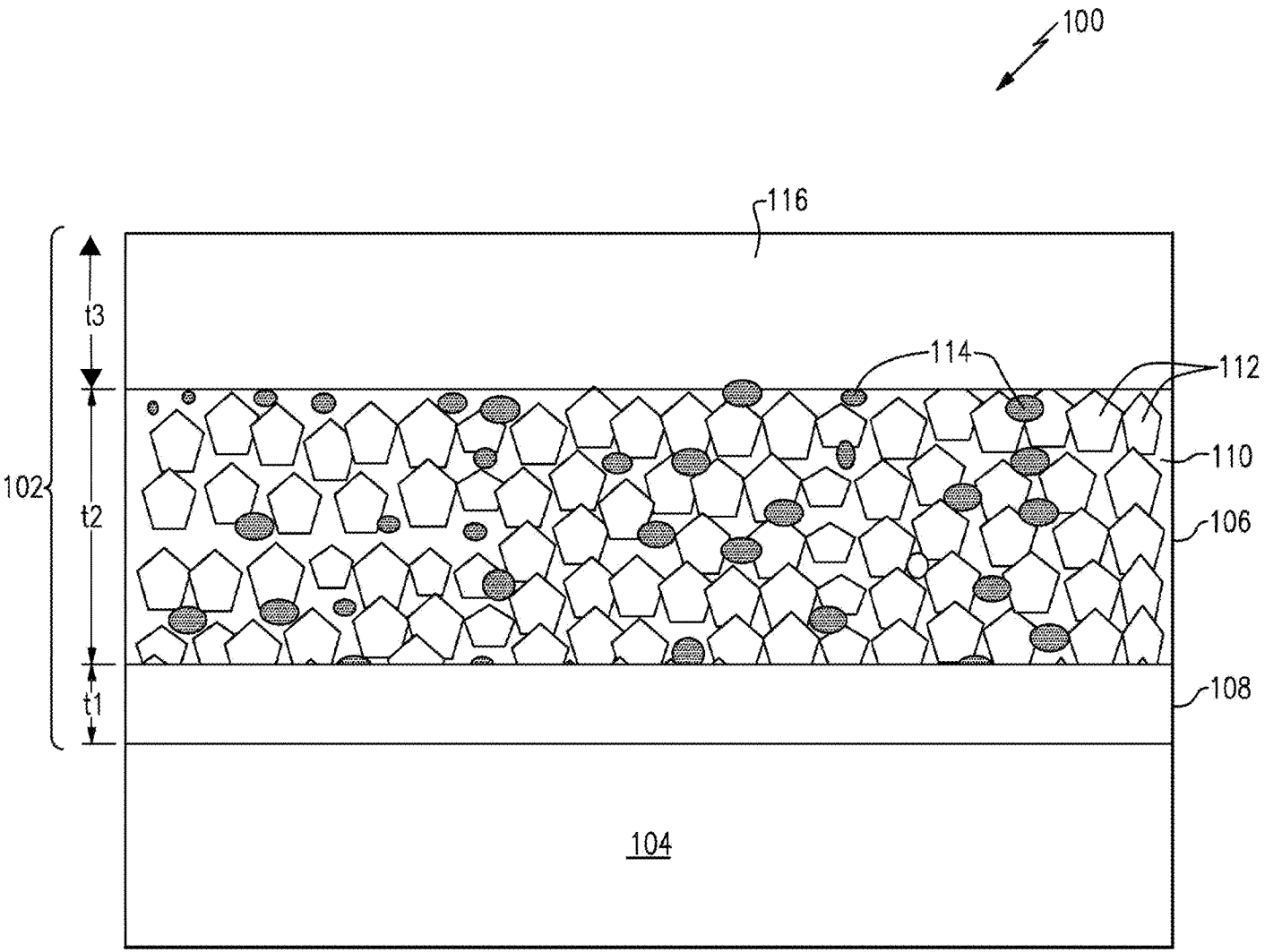
FIG. 1 is a partial schematic sectional view of a coated part.

FIG. 1 shows an article 100 having a high entropy alloy (HEA) substrate 104 and an optional coating system 102. Other implementations may have other coating compositions, layering, or the like or the substrate may be uncoated. Example coatings are those of the '608 publication. Thus, the example coating system 102 has a layering drawn from the '608 publication and comprises a diffusion barrier (barrier layer) 108, a bondcoat 106, and one or more additional layers. The example additional layer(s) form a thermal barrier coating (TBC), environmental barrier coating (EBC), abradable coating, or the like. The illustrated example includes a single additional layer 116.

An example diffusion barrier 108 comprises one or more silicides, borides or borosilicides of one of the elements in the HEA substrate. One particular example is $Mo_5SiB_2$. This by be applied by packed cementation or a fused slurry process.

An example bondcoat 106 comprises a matrix 110 and, in the matrix, gettering particles 112 and matrix modifier particles 114. Example gettering particles are reactive with respect to oxidant species such as oxygen or water that could diffuse into the barrier. In this way, the gettering particles could reduce the likelihood of those oxidant species reaching and oxidizing the substrate. Example gettering particles include metal silicides and refractory metal silicides. Example application is via slurry coating.

Example matrix modifier particles enhance substrate protection similarly to the gettering particles. Example matrix modifier particles are crystalline or partially crystalline particles, which are strong and enhance mechanical stability. Example matrix modifier particles are borides (e.g., silicon borides and metal borides), boron-containing oxides, silicates, and mixtures thereof.

Example matrix materials are silicon dioxide (silica ($SiO_2$)), alumina oxide, mullite, or combinations thereof.

An example additional layer 116 is a ceramic-topcoat that may be an oxide-based material or multiple oxide-based materials combined. The additional layer may be applied via plasma spraying.

Example substrates are used for hot gaspath components (e.g., combustor components and components downstream thereof) such as: turbine section blades; turbine section vanes; turbine section blade outer air seals; combustor shell pieces; combustor heat shield pieces; combustor fuel nozzles; and combustor fuel nozzle guides.

Table I below shows compositions and compositional ranges for various high entropy alloys (HEA) (all ranges inclusive of endpoints). These include four particularly promising examples (designated Ex. 1-4 along with ranges targeting these), some less promising examples (designated "comparative examples" ("Comp. Ex.")), and three prior art examples found in literature:

TABLE IA

| Compositions | | | | | | | | | | | |
|---|---|---|---|---|---|---|---|---|---|---|---|
| | | Candidate High Entropy Alloy Elements (At. or Wt. percent) | | | | | | | | | Other elements/ |
| Identification | Measure | Cr | Mo | Nb | Ta | Ti | V | Zr | W | A1 | comments |
| Ex. 1 | Nominal At. | 31.0 | 23.0 | | 11.0 | 2.0 | 33.0 | | | | |
| Ex. 1 | Nominal Wt. | 21.25 | 29.09 | | 26.24 | 1.26 | 22.16 | | | | |
| Range 1 | Wt % | 20.25-22.25 | 28.1-30.1 | | 25.25-27.25 | 0.75-1.75 | 21.15-23.15 | | | | |
| Range 2 | Wt % | 19.25-23.25 | 27.1-31.1 | <2.0 | 24.25-28.25 | 0.5-2.25 | 20.15-24.15 | ≤2.0 | ≤2.0 | <2.0 | |
| Range 3 | Wt % | 16.0-26.0 | 24.0-34.0 | <4.0 | 21.0-31.0 | 0.5-3.5 | 17.0-27.0 | ≤4.0 | ≤4.0 | <4.0 | |
| Ex. 2 | Nominal At. | 22.10 | 26.70 | | 24.00 | | 23.70 | 3.50 | | | |
| Ex. 2 | Nominal Wt. | 11.99 | 26.74 | | 45.33 | | 12.60 | 3.33 | | | |
| Range 1 | Wt % | 11.5-12.5 | 25.75-27.75 | | 43.3-47.3 | | 12.1-13.1 | 2.7-3.7 | | | |
| Range 2 | Wt % | 11.0-13.0 | 24.75-28.75 | <2.0 | 41.3-49.3 | <2.0 | 11.6-13.6 | 2.3-4.3 | <2.0 | <2.0 | |
| Range 3 | Wt % | 9.0-15.0 | 21.75-31.75 | <4.0 | 40.0-50.0 | <4.0 | 9.5-15.5 | 1.5-4.5 | <4.0 | <4.0 | |
| Ex. 3 | Nominal At. | 23.70 | 30.30 | | 22.50 | 6.60 | 16.80 | | | | |
| Ex. 3 | Nominal Wt. | 13.13 | 30.99 | | 43.39 | 3.37 | 9.12 | | | | |
| Range 1 | Wt % | 12.6-13.6 | 29.5-32.5 | | 41.4-45.4 | 2.9-3.9 | 8.6-9.6 | | | | |
| Range 2 | Wt % | 12.1-14.1 | 28.0-34.0 | <2.0 | 39.4-47.4 | 2.4-4.4 | 8.1-10.1 | <2.0 | <2.0 | <2.0 | |
| Range 3 | Wt % | 10.0-16.0 | 26.0-36.0 | <4.0 | 37.5-47.5 | 2.0-5.0 | 6.0-12.0 | ≤4.0 | <4.0 | <4.0 | |
| Ex. 4 | Nominal At. | 9.50 | 29.30 | | 11.30 | 24.70 | 25.10 | | | | |
| Ex. 4 | Nominal Wt. | 6.32 | 35.99 | | 26.18 | 15.14 | 16.37 | | | | |
| Range 1 | Wt % | 5.8-6.8 | 34.5-37.5 | | 25.2-27.2 | 14.6-15.6 | 15.8-16.8 | | | | |
| Range 2 | Wt % | 5.3-7.3 | 33.0-39.0 | ≤2.0 | 24.2-28.2 | 14.1-16.1 | 15.3-17.3 | <2.0 | ≤2.0 | <2.0 | |
| Range 3 | Wt % | 4.8-7.8 | 31.0-41.0 | <4.0 | 21.0-31.0 | 12.0-18.0 | 13.0-19.0 | ≤4.0 | <4.0 | <4.0 | |

TABLE IA-continued

| Compositions | | | | | | | | | | | |
|---|---|---|---|---|---|---|---|---|---|---|---|
| | | Candidate High Entropy Alloy Elements (At. or Wt. percent) | | | | | | | | | Other elements/ |
| Identification | Measure | Cr | Mo | Nb | Ta | Ti | V | Zr | W | A1 | comments |
| Ex. 1 & 4 Range 1 | Wt % | 4.8-26.0 | 24.0-41.0 | <4.0 | 21.0-31.0 | 0.5-18.0 | 13.0-27.0 | <4.0 | <4.0 | <4.0 | (Cr + Ti) 16.5-29.5 |
| Ex. 2 & 3 Range 1 | Wt % | 9.0-16.0 | 21.75-36.0 | <4.0 | 37.5-50.0 | <5.0 | 6.0-15.5 | <5.0 | <4.0 | <4.0 | (Ti + Zr) 1.5-5.0 |
| Ex. 1 & 2 Range 1 | Wt % | 9.0-26.0 | 21.75-34.0 | <4.0 | 21.0-50.0 | 0.5-3.5 | 9.5-27.0 | <4.5 | <4.0 | <4.0 | (Ti + Zr) 0.5-5.0 |
| Ex. 1-4 Range 1 | Wt % | 4.8-26.0 | 21.75-41.0 | <4.0 | 21.0-50.0 | <18.0 | 6.0-27.0 | <5.0 | ≤4.0 | ≤4.0 | (Mo + Ta) 45.0-80.0 (Cr/V) 0.25-1.6 |

TABLE IB

| Compositions | | | | | | | | | | | |
|---|---|---|---|---|---|---|---|---|---|---|---|
| | | Further Candidate High Entropy Alloy Elements (At. or Wt. percent) | | | | | | | | | Other |
| Identification | Measure | Cr | Mo | Nb | Ta | Ti | V | Zr | W | Al | elements/comments |
| Comp. Ex. A | Nominal At. | 17.10 | 31.20 | | 20.60 | | 31.20 | | | | |
| Comp. Ex. A | Nominal Wt. | 9.66 | 32.54 | | 40.52 | | 17.28 | | | | |
| Comp. Ex B | Nominal At. | 10.60 | 31.10 | | 15.50 | 22.70 | 20.20 | | | | |
| Comp. Ex B | Nominal Wt. | 6.52 | 35.29 | | 33.17 | 12.85 | 12.17 | | | | |
| Comp. Ex C | Nominal At. | 26.20 | 19.10 | | 11.70 | 8.80 | 34.20 | | | | |
| Comp. Ex C | Nominal Wt. | 18.22 | 24.52 | | 28.32 | 5.63 | 23.31 | | | | |
| Prior Art Ex. Z | Nominal At. | 20 | 20 | | 20 | 20 | | | | 20 | |
| Prior Art Ex. Y | Nominal At. | | 20 | 20 | 20 | | 20 | | 20 | | |
| Prior Art Ex. X | Nominal At. | | 25 | 25 | 25 | | | | 25 | | |

Blank spaces in Table I in the columns referencing the nine listed elements indicate a nominal zero value. An example is 0.0 in atomic or weight percent respectively. But this may include impurity levels in some embodiments. And, as discussed below, other embodiments may include small amounts above impurity levels. Elements other than those for which Table I lists a content (including elements not listed in the table at all) may still be present. And this includes some of the blank space entries for elements listed in the table where the nominal content of that element is zero. Thus, some of the ranges in the table list maximum example contents of specific elements for which the nominal associated composition has zero (e.g., true zero or commercial or inevitable impurity levels).

Example ranges of such elements (nominal zero or non-listed in table) may be: A) no more than 3.0 all other elements individually, if any, and no more than 6.0 all other elements, if any, combined; or B) no more than 1.0 all other elements individually, if any, and no more than 3.0 all other elements, if any, combined. These two examples of ranges may be applied alternatively as including, in the individual elements, elements listed in Table I but with nominal zero content or not including such elements.

For each of Examples 1-4, three associated ranges are given. For those of the nine listed elements wherein the nominal value is zero, ranges two and three list maximum values such as 2.0 and 4.0 weight percent, respectively. Nevertheless, alternative versions of ranges two and three may be created via lower maximum limits on these elements. For example, alternative maximum limits either of these ranges are 0.0, 0.50, 1.0, 2.0, 3.0, and 4.0. Such limits may also be used to create alternative version of each range one. As noted, these limits may, to create alternative effective ranges, be viewed on the one hand as alternative to including those elements in the general maximum limits on other elements (e.g., elements other than the nine listed) or in addition to such limits.

Similarly, ranges around each of the apparently less desirable Table IB comparative examples (or groups thereof) may be created by applying the same deltas used with the closest nominal values for the same elements along Examples 1-4.

Yet similar ranges may be created around the nominal atomic values based upon the relative numerical atomic contents of the different elements in a similar fashion to the relative weight contents.

Notable possible low-quantity intentional alloyants creating further variations/embodiments on any of the examples/ranges above include B, C, O, N, Y, and/or Si which are known to modify microstructure and performance in small amounts. Example amounts are up to 1.0 or 2.0 weight percent each for Y and Si and up to 0.50 weight percent each for B, C, O, and N. The substrates may thus consist of or consist essentially of these elements (if any) plus those of the table or these elements (if any) plus those of the table plus impurities (e.g., commercial or inevitable impurities).

Examples 2 and 3 are relatively close in Cr, Mo, Ta, and V. Ex. 2 has nominally no Ti and has a small amount of Zr, whereas Ex. 3 has nominally no Zr and a small amount of Ti. Thus, there may be overlap of ranges that target each such that the nominal value of one may fall within a moderate range around the other. A shared range may be created by taking, for elements other than Ti and Zr the extremes of an Ex. 2 range and an Ex. 3 range and then adding a combined Zr and Ti range based on the extremes for Zr and Ti. See Table IA.

Examples 1 and 4 have the same elements in nominal composition and are relatively close in Mo, Ta, and V. Ex. 1 has much lower Ti and lower Cr. Thus, there may be overlap of ranges that target each such that the nominal value of one may fall within a moderate range around the other. A shared range may be created by taking, for all elements the extremes of an Ex. 1 range and an Ex. 4 range and then adding a combined Cr and Ti range based upon the extremes for the two combined. See Table IA.

Table 1A similarly provides an example based on the Range 3 values for Ex 1 and Ex. 2. For the Ex. 1/2, 1/4, and 2/3 pairs similar ranges may be created using the Range 2 and Range 1 values. Table IA similarly provides a further example range referencing Examples 1-4.

Table II shows some predicted and measured properties:

TABLE II

| | Properties | | | | | | | | | |
|---|---|---|---|---|---|---|---|---|---|---|
| | Property | | | | | | | | | |
| Identification | Density (g/cm$^3$) Predicted | Melting Point (° C.) Predicted | Melting Point (° C.) Experimental | Yield Point at 1200° C. Measured (MPa)) | Yield Point at 1300° C. Measured (MPa) | Yield Point at 1400° C. Measured (MPa) | Yield Point at 1500° C. Measured (MPa) | Yield Point at 1600° C. Measured (MPa) | Phase | Room Temp. Vickers Hardness Measured |
| Ex. 1 | 8.87 | 2069 | >1600 | | 595 | | ~170 | | BCC | 594 |
| Ex. 2 | 10.45 | 1817 | >1500 | | 828 | | | | BCC | 740 |
| Ex. 3 | 10.304 | 2085 | >1600 | | 530 | | | | BCC | 682 |
| Ex. 4 | 8.34 | 2034 | >1500 | | 210 | | | | BCC | 482 |
| Comp Ex A | 10.23 | 2271 | | | | | | | BCC | 609 |
| Comp Ex B | 8.95 | 2060 | | | | | | | BCC | 543 |
| Comp Ex C | 8.54 | 1956 | | | | | | | BCC | 554 |
| Prior Art Ex. Z | 8.39 | 1132 | | | | | | | BCC | |
| Prior Art Ex. Y | 12.36 | | | 735 * | | 656 * | | 477 * | BCC | |
| Prior Art Ex X | 13.64 | | | 506 * | | 421 * | | 405 * | BCC | |

* Third party published data

The Table II experimental melting point data for Ex. 1-4 merely reflects peak temperatures of tests that did not reach the actual melting points. Thus, a >1500° C. entry does not evidence an actual melting point lower than a >1600° C. entry does.

In oxidative tests of Ex. 1-4 and the comparative examples, coupons of specimens were tested in an air furnace at 1000° C. for four hours. The samples were first heated in argon to prevent any oxidation before flowing air during the test. After four hour completion, the oxidative atmosphere was replaced with argon for cool-down.

Prior Art Ex. Z is a TaMoCrTiAl baseline alloy identified in literature for protective $CrTaO_4$ oxide formation and oxidation resistance. Its melt point is predicted by modelling to be too low and it is identified in the literature as being brittle below 1000° C. The $CrTaO_4$ oxide scale is shown in the literature to be continuous and protective with oxidation rates similar to alumina or chromia scales.

Prior Art Ex. Y is a MoNbTaVW alloy has high yield point at 1300° C. as reported in the literature and shown in our experiments as having no oxidation protection capability.

Prior Art Ex. X is a MoNbTaW alloy identified in literature as having a high yield point at 1300° C. and shown in our experiments as having no oxidation protection capability.

The Ex. 1 alloy was observed to have a thin oxide scale, gray in color, and no spallation (via visual observation and physical handling of test coupons).

The Ex. 2 alloy was observed to have a thin oxide scale, multicolored, and no spallation. It exhibited higher yield strength at 1300° C. than Ex. 1. However, the multicolored oxide scale indicates likely multiple oxides are formed and a protective scale is not as likely. Thus, it is believed to have less effective/practical oxidation resistance. The effective/practical oxidation resistance reflects not merely the chemical potential driving oxidation but also whether the oxide composition and morphology does or does not protect against further in-service oxidation such as the protection offered in anodization.

The Ex. 3 alloy was observed to have a thin oxide scale, gray in color, with slight whiskers possible, but no spallation. It exhibited slightly lower yield strength at 1300° C. than Ex. 1. However, the observation of whiskers may indicate the formation of MoO that indicate the potential for pesting. Thus, it is believed to have less effective/practical oxidation resistance.

The Ex. 4 alloy was observed to have a thin oxide scale, gray in color, and no spallation. This may have similar or greater oxidation resistance than Ex. 1. However, it exhibited lower yield strength at 1300° C. than Ex. 1. This may limit applications (e.g., to nonrotating components and other components that are not heavily loaded/stressed).

Comp. Ex. A had significant oxidation and exhibited melting in the oxidation test. This departure from a high predicted melting point (Table II) may be due to compositional changes associated with the oxidation locally lowering the melting point.

Comp. Ex. B had thick grey oxidation. The thickness suggests excessive drivers of oxidation. Also, it had low predicted strength. The low Vickers hardness tends to confirm potential low strength.

Comp. Ex. C had thin grey oxidation. This seemed promising. The low density suggests this, like Ex. 4, may be used in lower required strength and/or weight-sensitive applications.

In general, it may be desirable that the 1300° C. yield point (e.g., yield point or yield strength or 0.2% offset yield point) of the alloy be at least 500 MPa, or at least 570 MPa. Example 1300° C. yield points are 500 MPa to 900 MPa. As noted above relative to Ex. 4, for relatively unloaded/unstressed components, a lower limit of yield point (e.g., as low as 190 MPa or 150 MPa if not lower) may be acceptable. For rotating components, there is a significant relationship between yield point and density because higher density imposes higher centrifugal loading and thus tensile forces requiring a higher yield strength. Example density is 8.0-11.0 g/cm$^3$. However slightly lower density may be achieved in some embodiments and narrower ranges are provided herein for variations on the four respective examples. With some embodiments increased operating temperature of the engine provides efficiency gains. The added weight of higher density embodiments may only partially counter that efficiency gain, so there is a trade-off.

Given the lack of commercial success of HEA heretofore, in many implementations the HEA substrate 104 will be expected to replace baseline nickel-based superalloy substrates. But in some implementations, it may replace another HEA substrate or a CMC substrate. Relative to a nickel-based superalloy substrate (e.g., a baseline being replaced), the HEA substrate 104 may present a different balance of considerations for a coating system (if coated). Relative to the baseline substrate, the HEA substrate may have a higher melting point and better high temperature strength (e.g., yield strength and ultimate tensile strength). However, oxidation may be a more significant problem for the HEA at least in relative terms and potentially in absolute terms. Regarding relative terms, the HEA substrate may be more prone to oxidation at an example operating temperature of 1200° C. or 1300° C. than the baseline alloy is at its lower example baseline operating temperature of 900° C. or 1000° C. Regarding absolute terms, the HEA substrate may be more prone to oxidation than the baseline substrate even at the baseline operating temperature.

Thus, oxidation behavior may increase the absolute importance (relative to a conventional superalloy baseline) of a coating operating as an environmental barrier coating to protect the HEA substrate from chemical attacks such as oxidation. Similarly, the melting point and high temperature yield strength of the HEA may offer a significant margin above its intended elevated operational temperature to reduce the absolute need for an insulative (TBC) coating relative to the baseline. Thus, these combined factors may substantially shift the role of the coating from the insulative role of a thermal barrier coating system in a baseline to the chemical protection role of an environmental barrier coating system.

This shifted balance toward chemical protection from insulation may involve similar considerations to certain protective coatings used on ceramic or ceramic matrix composite (CMC) substrates. However, one group of examples of a coating system involves one or more layers taken from the coating systems of the '608 publication.

Example diffusion barrier 108 thicknesses t1 are 0.5 to 500 micrometers, more narrowly 20 to 150 micrometers. Example bondcoat 106 thicknesses t2 are 0.5 to 500 micrometers, more narrowly 20 to 150 micrometers. Example EBC/TBC 116 thicknesses t3 are 0.5 to 500 micrometers, more narrowly 20 to 150 micrometers. Particular coatings would depend on particular parts (components) and conditions.

Alloy and/or substrate manufacture techniques may be otherwise conventional. For example, bulk alloy (e.g., ingots) may be formed by master casting processes or compacting elemental powder and sintering. HEA powders may be formed from HEA ingots or the like such as via atomization from plasma spray. Alternatively, HEA powder may be made from atomizing a mixture of powders of individual elements or mixture of alloy(s) and element(s).

Components (substrates) can be produced from casting, forging, powder metallurgy (e.g., including spark plasma sintering), or additive manufacturing (e.g., laser or electron beam) from the feed stock. This may be direct from HEA feedstock or from mixtures of components.

Figure 2:
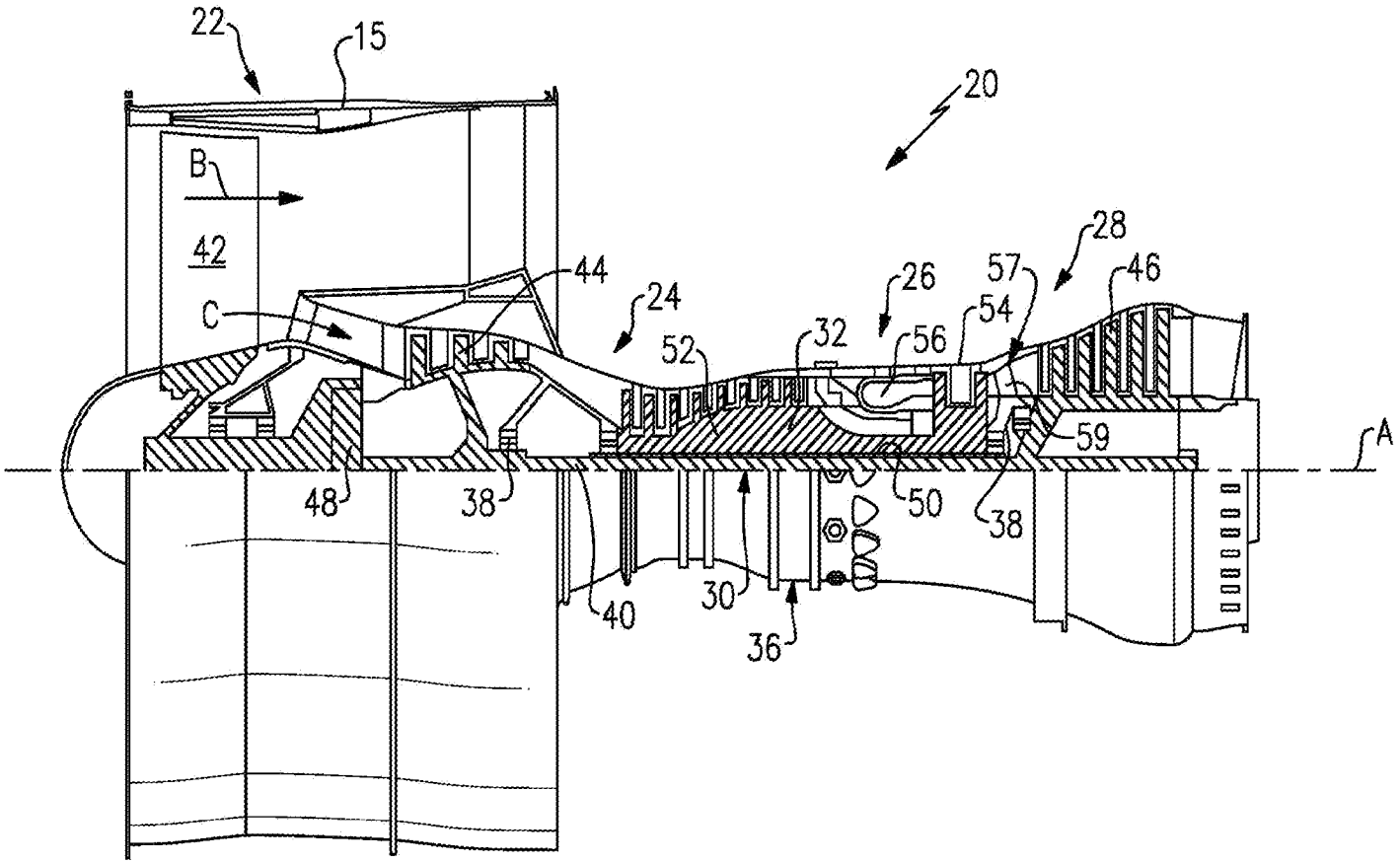
FIG. 2 is a schematic longitudinal half-sectional view of a gas turbine engine.

FIG. 2 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 may include a single-stage fan 42 having a plurality of fan blades. The fan blades may have a fixed stagger angle or may have a variable pitch to direct incoming airflow from an engine inlet. The fan 42 drives air along a bypass flow path B in a bypass duct 13 defined within a housing 15 such as a fan case or nacelle, and also drives air along a core flow path C for compression and communication into the combustor section 26 then expansion through the turbine section 28. A splitter aft of the fan 42 divides the air between the bypass flow path B and the core flow path C. The housing 15 may surround the fan 42 to establish an outer diameter of the bypass duct. The splitter may establish an inner diameter of the bypass duct. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in the example gas turbine engine 20 is illustrated as a geared architecture 48 to drive the fan 42 at a lower speed than the low speed spool 30. The inner shaft 40 may interconnect the low pressure compressor (LPC) 44 and low pressure turbine (LPT) 46 such that the low pressure compressor 44 and low pressure turbine 46 are rotatable at a common speed and in a common direction. In other embodiments, the low pressure turbine 46 drives both the fan 42 and low pressure compressor 44 through the geared architecture 48 such that the fan 42 and low pressure compressor 44 are rotatable at a common speed. Although this application discloses geared architecture 48, its teaching may benefit direct drive engines having no geared architecture. The high speed spool 32 includes an outer shaft 50 that interconnects a second (or high) pressure compressor (HPC) 52 and a second (or high) pressure turbine (HPT) 54. A combustor 56 is arranged in the example gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

Airflow in the core flow path C is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core flow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The low pressure compressor 44, high pressure compressor 52, high pressure turbine 54 and low pressure turbine 46 each include one or more stages having a row of rotatable airfoils. Each stage may include a row of static vanes adjacent the rotatable airfoils. The rotatable airfoils and vanes are schematically indicated.

The engine 20 may be a high-bypass geared aircraft engine. The bypass ratio can be greater than or equal to 10.0 and less than or equal to about 18.0, or more narrowly can be less than or equal to 16.0. The geared architecture 48 may be an epicyclic gear train, such as a planetary gear system or a star gear system. The epicyclic gear train may include a sun gear, a ring gear, a plurality of intermediate gears meshing with the sun gear and ring gear, and a carrier that supports the intermediate gears. The sun gear may provide an input to the gear train. The ring gear (e.g., star gear system) or carrier (e.g., planetary gear system) may provide an output of the gear train to drive the fan 42. A gear reduction ratio may be greater than or equal to 2.3, or more narrowly greater than or equal to 3.0, and in some embodiments the gear reduction ratio is greater than or equal to 3.4. The gear reduction ratio may be less than or equal to 4.0. The fan diameter is significantly larger than that of the low pressure compressor 44. The low pressure turbine 46 can have a pressure ratio that is greater than or equal to 8.0 and in some embodiments is greater than or equal to 10.0. The low pressure turbine pressure ratio can be less than or equal to 13.0, or more narrowly less than or equal to 12.0. Low pressure turbine 46 pressure ratio is pressure measured prior to an inlet of low pressure turbine 46 as related to the pressure at the outlet of the low pressure turbine 46 prior to an exhaust nozzle. It should be understood, however, that the above parameters are only example of one embodiment of a geared architecture engine and that the present disclosure is applicable to other gas turbine engines including direct drive turbofans. All of these parameters are measured at the cruise condition described below.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above, and those in the next paragraph are measured at this condition unless otherwise specified.

"Low fan pressure ratio" is the pressure ratio across the fan blade alone, without a Fan Exit Guide Vane ("FEGV") system. A distance is established in a radial direction between the inner and outer diameters of the bypass duct at an axial position corresponding to a leading edge of the splitter relative to the engine central longitudinal axis A. The low fan pressure ratio is a spanwise average of the pressure ratios measured across the fan blade alone over radial positions corresponding to the distance. The low fan pressure ratio can be less than or equal to 1.45, or more narrowly greater than or equal to 1.25, such as between 1.30 and 1.40. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "low corrected fan tip speed" can be less than or equal to 1150.0 ft/second (350.5 meters/second), and greater than or equal to 1000.0 ft/second (304.8 meters/second).

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline component, details of such baseline may influence details of particular implementations. Accordingly, other embodiments are within the scope of the following claims.

What is claimed is:

1. An alloy comprising by weight percent:
19.25-23.25 Cr;
27.10-31.10 Mo;
24.25-28.25 Ta;
0.5-2.25 Ti;
15-24.15 V; and
no more than 5.0 Zr, if any.

2. The alloy of claim 1 comprising by weight percent:
no more than 4.5 Zr, if any; and
0.5-5.0 said Ti and Zr combined.

3. The alloy of claim 2 further comprising:
no more than 4.0 Nb, if any;
no more than 4.0 W, if any;
no more than 4.0 Al, if any;
no more than 3.0 all other elements individually, if any; and
no more than 6.0 all other elements, if any, combined.

4. The alloy of claim 1 comprising by weight percent:
20.25-22.25 Cr;
28.10-30.10 Mo;
25.25-27.25 Ta;
0.75-1.75 Ti; and
21.15-23.15 V.

5. The alloy of claim 1 comprising in weight percent:
20.25-22.25 Cr;
28.10-30.10 Mo:
25.25-27.25 Ta;
0.75-1.75 Ti; and
21.15-23.15 V.

6. The alloy of claim 5 further comprising:
no more than 1.0 all other elements individually, if any; and
no more than 3.0 all other elements, if any, combined.

7. The alloy of claim 1 wherein by weight percent:
(Mo+Ta) is 45.0-80.0; and
(Cr/V) is 0.25-1.6.

8. The alloy of claim 1 further comprising:
no more than 4.0 Nb, if any;
no more than 4.0 W, if any;
no more than 4.0 Al, if any;
no more than 3.0 all other elements individually, if any; and
no more than 6.0 all other elements, if any, combined.

9. The alloy of claim 1 further comprising:
no more than 1.0 all other elements individually, if any; and
no more than 3.0 all other elements, if any, combined.

10. The alloy of claim 1 consisting essentially of:
said Cr; said Mo; said Ta; said V; said Ti, if any; said Zr, if any;
up to 2.0 weight percent each Y and Si, if any; and
up to 0.50 weight percent each B, C, O, and N, if any.

11. The alloy of claim 1 having at least one of:
a density of 8.80 to 9.10 grams per cubic centimeter;
a 1300° C. yield point of at least 500 MPa; and
a melting point of at least 1600° C.

12. The alloy of claim 1 having a BCC structure.

13. The alloy of claim 1 as a coated substrate having a coating comprising one or more:
silicide-based coatings;
zirconia-yttria based coatings;
rare-earth oxide coatings; and
mixtures thereof.

14. A gas turbine engine component comprising:
a substrate comprising:
4.8-26.0 Cr;
21.75-41.0 Mo;
21.0-50.0 Ta;
6.0-27.0 V;
no more than 18.0 Ti, if any; and
no more than 5.0 Zr, if any; and
a coating.

15. The gas turbine engine component of claim 14 wherein:
the component is a hot section component.

16. The gas turbine engine component of claim 15 wherein the component is selected from the group consisting of:
blades, vanes, blade outer air seals; combustor shell pieces, combustor heat shield pieces, combustor fuel nozzles, and combustor fuel nozzle guides.

17. A coated substrate having:
a substrate comprising:
4.8-26.0 Cr;
21.75-41.0 Mo;
21.0-50.0 Ta;
6.0-27.0 V;
no more than 18.0 Ti, if any; and
no more than 5.0 Zr, if any; and
a coating comprising one or more:
silicide-based coatings;
zirconia-yttria based coatings;
rare-earth oxide coatings; and
mixtures thereof.

18. The coated substrate of claim 17 wherein:
the coated substrate is a hot section component.

19. The coated substrate of claim 18 wherein the component is selected from the group consisting of:
blades, vanes, blade outer air seals; combustor shell pieces, combustor heat shield pieces, combustor fuel nozzles, and combustor fuel nozzle guides.

20. An alloy comprising by weight percent:
4.8-26.0 Cr;
21.75-41.0 Mo;
21.0-50.0 Ta;
6.0-27.0 V;
no more than 18.0 Ti, if any; and
no more than 5.0 Zr, if any,
the alloy having at least one of:
a density of 8.80 to 9.10 grams per cubic centimeter;
a 1300° C. yield point of at least 500 MPa; and
a melting point of at least 1600° C.

* * * * *